US006033054A

United States Patent [19]

Takagi

[11] Patent Number: 6,033,054

[45] Date of Patent: Mar. 7, 2000

[54] RECORDING APPARATUS AND COPYING MACHINE EQUIPPED WITH THE RECORDING APPARATUS

[75] Inventor: Eiichi Takagi, Yokohama, Japan

[73] Assignee: Canon Kabushiki Kaisha, Tokyo, Japan

[21] Appl. No.: 07/986,699

[22] Filed: Dec. 8, 1992

[30] Foreign Application Priority Data

Dec. 9, 1991 [JP] Japan ..... 3-324355

[51] Int. Cl.[7] ..... B41J 21/01

[52] U.S. Cl. ..... 347/43; 347/5

[58] Field of Search ..... 346/140 R, 1.1; 347/43, 12, 14, 5, 9, 13, 19; 358/502

[56] References Cited

U.S. PATENT DOCUMENTS

| | | | |
|---|---|---|---|
| 4,453,166 | 6/1984 | Enoto | 347/171 |
| 4,723,129 | 2/1988 | Endo et al. | 347/56 |
| 4,740,796 | 4/1988 | Endo et al. | 347/56 |
| 5,107,332 | 4/1992 | Chen | 358/518 |
| 5,355,159 | 10/1994 | Kaneko | 358/502 X |
| 5,398,053 | 3/1995 | Hirosawa et al. | 347/13 |

FOREIGN PATENT DOCUMENTS

| | | | |
|---|---|---|---|
| 1-196351 | 8/1989 | Japan . | |
| 03267864 | 11/1991 | Japan | H04N 1/23 |
| 03267865 | 11/1991 | Japan | H04N 1/23 |
| 03267866 | 11/1991 | Japan | H04N 1/23 |

OTHER PUBLICATIONS

Withdrawn Patent to Yoshioka et al., #5,182,637, Jan. 26, 1993.

*Primary Examiner*—N. Le
*Assistant Examiner*—L. Nguyen
*Attorney, Agent, or Firm*—Fitzpatrick, Cella, Harper & Scinto

[57] ABSTRACT

A copying machine equipped with a recording apparatus having multi-nozzle heads for respective color components, cyan, magenta, yellow and black, is disclosed. The copying machine has a device which, if a non-ejecting nozzle is present in the head for black ink among the multi-nozzle heads, stores the number of the non-ejecting nozzle; and a recording control device which, when an ejection signal is given to the non-ejecting nozzle, causes a nozzle of each of the ink heads for cyan, magenta and yellow, the nozzle having the same number as the number of the non-ejecting nozzle, to eject ink.

44 Claims, 8 Drawing Sheets

RECORDING APPARATUS AND COPYING MACHINE EQUIPPED WITH THE RECORDING APPARATUS

BACKGROUND OF THE INVENTION

1. Field of the Invention

The present invention relates to a recording apparatus, especially a color recording apparatus, and a copying machine equipped with such a recording apparatus.

2. Description of the Prior Art

In recent years, ink jet type full-color recording apparatuses provided with multiple nozzles for respective color components, i.e. cyan, magenta, yellow and black, have found use in computer terminals, copying machines or facsimiles.

FIG. 1 is a sectional view showing the internal structure of a color copying machine as disclosed in Japanese Patent Application Laying-Open No. 196351/1989.

The upper part of the machine in FIG. 1 is composed of a color image scanner portion 1 which reads the image of an original and outputs digital color image data (hereinafter referred to as the scanner portion 1); and a controller portion 2 which is housed in the scanner portion 1, performs various image-processing operations for digital color image data and has processing functions, such as interfacing with external devices.

The controller portion 2 issues operation-related instructions to the scanner portion 1 and a printer portion 3 in accordance with information that has been entered.

The lower part of the machine in FIG. 1 is the printer portion 3 for recording onto a recording paper a color digital image signal outputted by the controller portion 2.

In the scanner portion 1, the image of an original placed on glass plate 17 and pressed by an original cover 11, a projected image from a projector, or a sheet original image supplied by a sheet feed mechanism 12 is read by an exposure lamp 14, a lens 15, and an image sensor 16 (e.g. CCD) capable of reading line images with full-color, that is the original image is read in such a manner that the color of the image is resolved in respective color component of red, green and blue. Then, various image processing operations are performed by the scanner portion 1 and the controller portion 2, and the processed image is recorded by the printer portion 3 onto a recording medium.

The printer portion 3 is in the form of a full-color ink jet printer which uses a recording head of an ink jet recording type as disclosed in U.S. Pat. Nos. 4,723,129 or 4,740,796, namely, a recording head having an electro-thermal converter (heat generator) for an ejection energy generation element as a recording energy generation means.

The above-described two portions are separable from each other, and may of course be disposed apart from each other when connected via an extended connecting cable.

In FIG. 1, a recording medium such as paper, film or the like (hereinafter referred to as the recording paper) is fed from a paper feed cassette 20 which accommodates cut-sheet recording papers (hereinafter referred to as the cut paper(s)) of a small fixed size (A4 to A3 size in this case), or is fed from a rolled paper 29 for recording of a large size (the A2 to A1 size in this case).

A pickup roller 24 is a roller for feeding the cut papers one by one from the paper feed cassette 20. The cut paper fed is conveyed by cut paper delivery rollers 25 to a paper feed first roller 26.

The rolled paper 29 is fed by a rolled paper feed roller 30, cut by a cutter 31 to a fixed length, and conveyed to the paper feed first roller 26.

Similarly, the recording paper inserted manually is carried by a manual feed roller 32 to the paper feed first roller 26.

The pickup roller 24, cut paper delivery rollers 25, rolled paper feed roller 30, paper feed first roller 26, and manual feed roller 32 are driven by a paper feed motor (e.g. a DC servomotor is available) which is not shown, and these rollers can be brought under on-off control at any time by means of an electromagnetic clutch attached to each roller.

Once a printing operation is started by an instruction from the controller portion 2, the recording paper which has been selected and fed through one of the above-mentioned feeding paths is carried to the paper feed first roller 26. Then, a predetermined amount of a paper loop is formed in order to prevent a bias travel of the recording paper. Afterwards, the paper feed first roller 26 is actuated to convey the recording paper to a paper feed second roller 27.

Between the paper feed first roller 26 and the paper feed second roller 27, the recording paper is caused to sag by a predetermined amount to form a buffer so that an accurate paper feeding operation can be performed between these rollers. A buffer amount sensor 33 is a sensor for detecting the amount of the buffer. The constant formation of such a buffer during paper carriage makes it possible to reduce a load to be imposed on a paper delivery roller 28 and the paper feed second roller 27, particularly, during the conveyance of a large-sized recording paper. Hence, the paper can be delivered accurately.

During printing by a recording head 37, a scanning carriage 34 composed of the recording head 37, etc. is caused to perform reciprocating scanning on carriage rails 36 by the action of a scanning motor 35. During scanning on a forward path, an image is printed on the recording paper. During scanning on a backward path, the recording paper is delivered by a predetermined amount by means of the paper delivery roller 28. At this time, the aforementioned driving system is controlled so that a predetermined amount of buffer is ensured by the paper feed motor while the buffer amount is being detected by the buffer amount sensor 33.

The recording paper that has been printed on is discharged onto a copy receiving tray 23, and the printing operation is thus completed.

Next, a detailed description of the surroundings of the scanning carriage 34 will be offered with reference to FIG. 2.

In FIG. 2, a paper delivery motor 40 is a drive source for intermittently delivering the recording paper. This motor drives the paper delivery roller 28, and also drives the paper feed second roller 27 via a paper feed second roller clutch 43.

The scanning motor 35 is a drive source for causing the scanning carriage 34 to scan in the directions of arrows A and B via a scanning belt 42. In this example, pulse motors are used as the paper delivery motor 40 and the scanning motor 35 so that paper delivery can be controlled accurately.

When the recording paper has reached the paper feed second roller 27, the clutch 43 and the paper delivery motor 40 are actuated to convey the recording paper on a platen 39 to the paper delivery roller 28.

The recording paper is detected by a paper sensor 44 provided on the platen 39. The information on its detection is utilized for positional control, jam control, etc.

When the recording paper has reached the paper delivery roller 28, the clutch 43 and the paper delivery motor 40 are turned off. At the same time, a suction operation is performed from inside of the platen 39 by means of a suction motor (not shown) to attract the recording paper onto the platen 39.

Prior to the image recording onto the recording paper, the scanning carriage 34 is moved to the position of a home position sensor 41. Then, forward scanning is carried out in the direction of arrow A. During this action, inks of cyan (C), magenta (M), yellow (Y) and black (BK) are ejected from predetermined positions by the recording heads 37 provided in correspondence to the respective colors, whereby an image is recorded. Upon completion of image recording corresponding to a predetermined length, the scanning carriage 34 is brought to a halt. Backward scanning is begun in the opposite direction, the direction of arrow B, whereby the scanning carriage 34 is returned to the position of the home position sensor 41. During the backward scanning, that amount of the paper corresponding to the length of the paper recorded by the recording heads 37 is delivered in the direction of arrow C by driving the paper delivery roller 28 by means of the paper delivery motor 40.

The recording heads 37 use four ink jet heads corresponding to the above-mentioned respective colors. The reference numeral 49 is a variable resistor which is provided for each recording head and used to set the optimal driving voltage value for each recording head.

By repeating the procedure described above, images are recorded on the entire surface of the recording paper.

In the conventional color copying machine with a multi-nozzle head, as described hereinabove, the original to be copied was read by a sensor, and the resulting signals for red (R), green (G) and blue (B) were converted by using a masking table RAM (random access memory) into signals for respective components, cyan (C), magenta (M), yellow (Y) and black (BK). The converted signals were further binarized to become on-off signals for the respective nozzles so that color copying would be performed.

The foregoing conventional example, however, posed the following problem: If a non-ejecting portion occurred in any of the nozzles of BK head (BK nozzle,) owing to clogging or some other cause, a recording operation was performed as a whole with the defective nozzle failing to eject. As a result, an unrecorded portion was present in a streaky form in the resulting copied image as if a white line were drawn there. Consequently, an image with a poor finish was obtained.

SUMMARY OF THE INVENTION

The present invention has been accomplished to overcome the above-described drawbacks of the conventional machine. An object of the present invention is to provide a recording apparatus capable of forming a clear image even if there is a non-ejecting nozzle in the ink jet heads.

Another object of the invention is to provide a copying machine equipped with the recording apparatus.

In the first aspect of the present invention, a recording apparatus for performing recording by using a plurality of heads, which eject inks for cyan, magenta, yellow and black and which have multiple nozzles, comprises:

means for storing the number of a non-ejecting nozzle of one of the plural heads; and recording control means which causes a nozzle of at least one head of the other three heads, which nozzle has the same number as the number of the non-ejecting nozzle, to eject ink, when an ejection signal is given to the non-ejecting nozzle of the one head.

Here, the non-ejecting nozzle may be a nozzle of the head for ejecting the black ink.

The plurality of heads may be ink jet recording heads which form bubbles in the ink by utilizing heat energy so that the ink is ejected by the action of the bubbles formed.

The recording control means may cause a nozzle of each of the other three heads, which nozzle has the same number as the number of the non-ejecting nozzle, to eject ink, when an ejection signal is given to the non-ejecting nozzle of the head for ejecting the black ink.

Here, the recording apparatus may further comprise means by which to detect which nozzle is the non-ejecting nozzle in numerical order.

In the second aspect of the present invention, a copying machine equipped with a recording apparatus having a plurality of heads, which eject inks for cyan, magenta, yellow and black and which have multiple nozzles, comprises:

reading means for reading an original to be copied and outputting signals for red, green and blue in accordance with the image information of the original;

color signal conversion means for converting the signals for red, green and blue into signals for yellow, magenta, cyan and black;

means for storing the number of a non-ejecting nozzle of one of the plurality of heads; and recording control means which causes a nozzle of at least one of the other three heads, which nozzle has the same number as the number of the non-ejecting nozzle, to eject ink, when an ejection signal is given to the non-ejecting nozzle of the one head.

Here, the plurality of heads may be ink jet recording heads which form bubbles in the ink by utilizing heat energy so that the ink is ejected by the action of the bubbles formed.

In the third aspect of the present invention, a copying machine equipped with a recording apparatus having a plurality of heads which eject inks for cyan, magenta, yellow and black and which have multiple nozzles, comprises:

reading means for reading an original to be copied and outputting signals for red, green and blue in accordance with the image information of the original;

color signal conversion means for converting the signals for red, green and blue into signals for yellow, magenta, cyan and black;

recording control means for controlling the actuation of the plurality of heads; and computing means for changing the color signal conversion coefficients of the color signal conversion means such that when an ejection signal is given to the non-ejecting nozzle of the one head, a nozzle of at least one of the other three heads, which nozzle has the same number as the number of the non-ejecting nozzle, is caused to eject ink.

Here, the plurality of heads may be ink jet recording heads which form bubbles in the ink by utilizing heat energy so that the ink is ejected by the action of the bubbles formed.

In the fourth aspect of the present invention, a method of recording comprises the steps of:

providing a plurality of heads which eject inks for cyan, magenta, yellow and black and which have multiple nozzles respectively, detecting which nozzle a non-ejecting nozzle of the head for ejecting the ink for black is in numerical order; and causing a nozzle of each of the other three heads, which nozzle has the same number as the number of the non-ejecting nozzle, to eject ink, when an ejection signal is given to the non-ejecting nozzle.

In the fifth aspect of the present invention, a method for copying comprises the steps of:

providing a plurality of heads which eject inks for cyan, magenta, yellow and black and which have multiple nozzles respectively, reading an original to be copied and outputting signals in accordance with the image information of the original, detecting which nozzle a non-ejecting nozzle of the head for ejecting the ink for black is in numerical order; and causing a nozzle of each of the other three heads, which nozzle has the same number as the number of the non-ejecting nozzle, to eject ink, when an ejection signal is given to the non-ejecting nozzle.

The above and other objects, effects, features and advantages of the present invention will become more apparent from the following description of embodiments thereof taken in conjunction with the accompanying drawings.

A further aspect of this invention concerns an ink jet recording apparatus for ejecting ink to record on a recording medium. The recording apparatus has a recording head assembly, which recording head assembly includes plural recording heads corresponding to black ink, cyan ink, magenta ink and yellow ink, respectively and each respective recording head has plural ejection means for ejecting ink. The apparatus also includes input means for inputting image signals of an image to be recorded, conversion means for converting the inputted image signals to ejection signals which indicate to respective ejection means of the plural recording heads whether to eject ink, and means for specifying that a particular ejection means from among the plural ejection means of the recording head corresponding to at least black ink is unable to eject ink. A conversion control means converts the ejection signals for the ejection means on a corresponding portion of the recording head corresponding to a color other than black to signals to eject ink, when an ejection signal for the ejection means of the recording head corresponding to black ink is a signal to eject ink and the ejection means of the recording head corresponding to black ink is unable to eject ink. The conversion control means converts the ejection signals to eject ink from the recording heads corresponding to at least cyan, magenta and yellow ink onto a recording position corresponding to a recording position from the ejection means, which is unable to eject ink, among the ejection means of the recording heads corresponding to black ink, and to compensate recording.

DETAILED DESCRIPTION OF PREFERRED EMBODIMENTS

Figure 1:
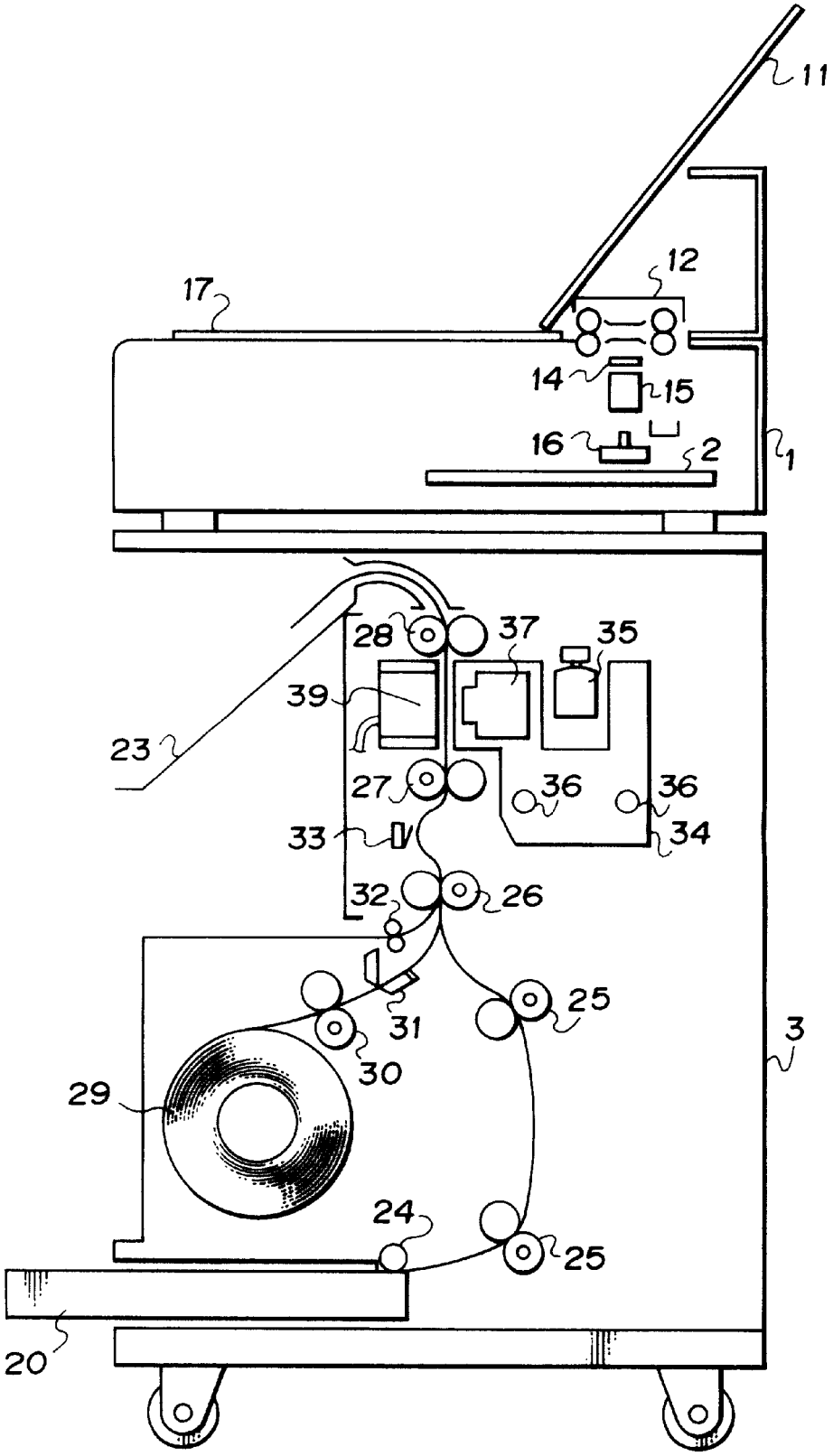
FIG. 1 is a sectional view showing an example of the internal structure of a digital color copying machine.
Figure 2:
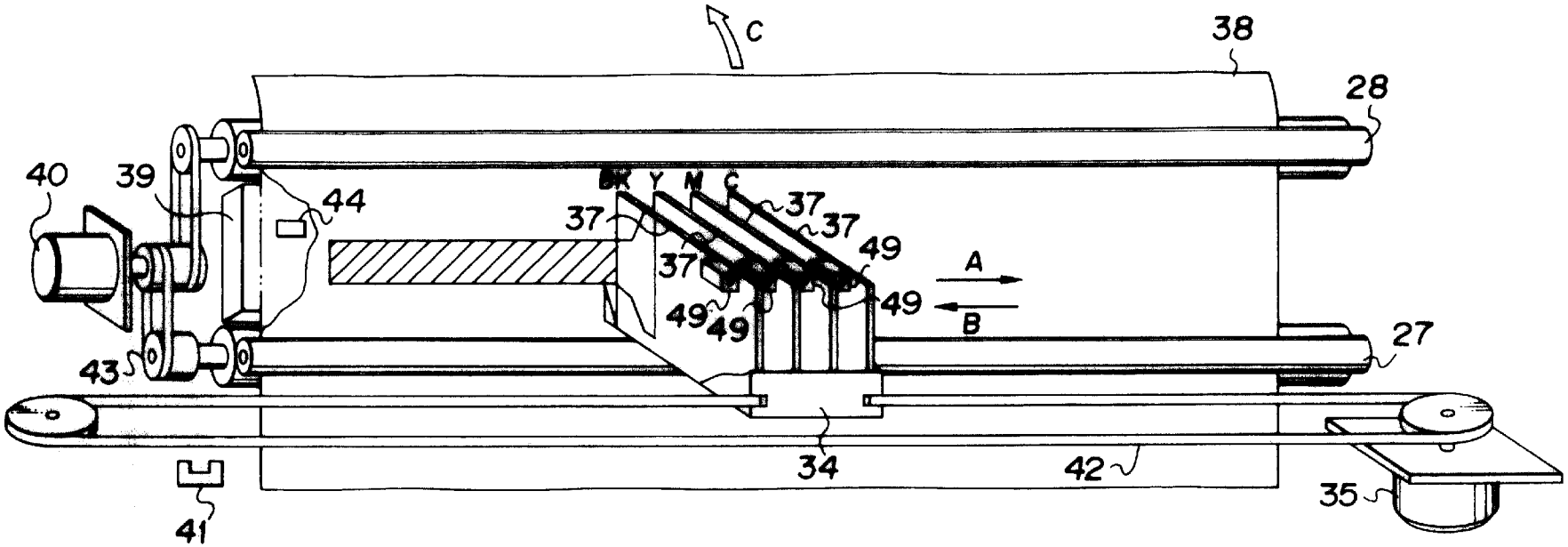
FIG. 2 is a perspective view showing a detailed structural example of the surroundings of the scanning carriage 34 of the printer portion.

The present invention can be applied, for example, to a copying machine as illustrated in FIG. 1.

Figure 3:
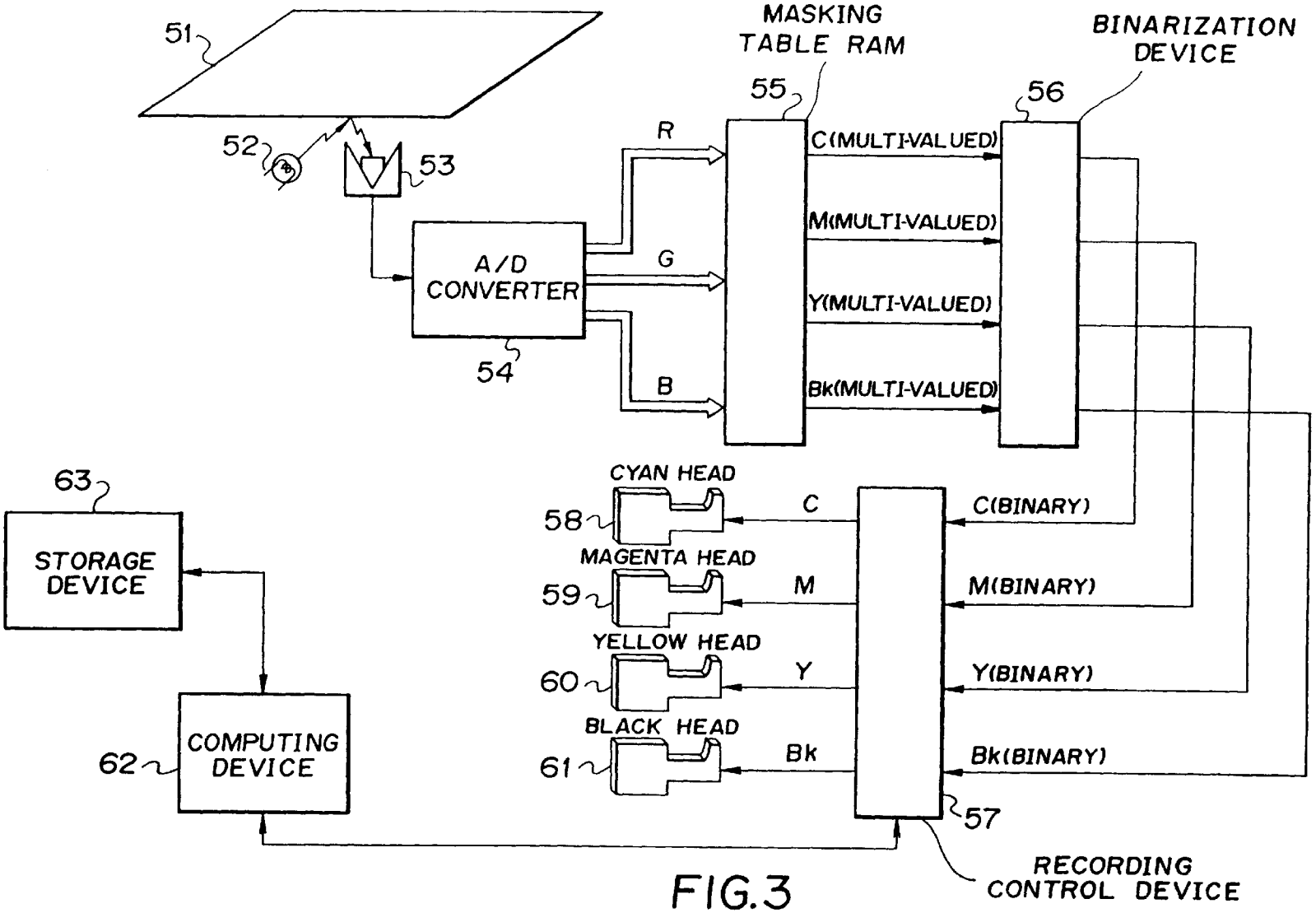
FIG. 3 is a block diagram showing the outline of the copying machine as an embodiment of the present invention.

FIG. 3 is a block diagram showing the outline of a copying machine to which the present invention has been applied. An original 51 to be copied is irradiated with light from a light source 52, and its image is read by a sensor 53 comprising, say, CCD. The sensor 53 outputs analog output signals in accordance with the image information read from the original. These analog signals are entered in an A/D converter 54 to be converted into multi-valued digital signals for R, G and B. These multi-valued digital signals for R, G and B are converted via a masking table RAM 55 into signals for C, M, Y and BK which designate respective color components for recording inks. These converted signals for C, M, Y and BK which are multi-valued are binarized by a binarization device 56, and entered into a recording control device 57. The recording control device 57 drives and controls each head with a plurality of nozzles (in the present embodiment, a multi-nozzle head 58 for cyan, a multi-nozzle head 59 for magenta, a multi-nozzle head 60 for yellow, and a multi-nozzle head 61 for black) based on the binarized signals for C, M, Y and BK, thereby forming a copied image. A computing device 62 performs computing operations, such as various comparisons of the signals for C, M, Y and BK for recording, by reference to the data stored in a storage device 63.

In the present embodiment, the recording heads 58 to 61 are ink jet heads, each of which relies on a film boiling phenomenon and has 256 nozzles provided in a longitudinal direction, namely a direction perpendicular to the scanning direction of the head.

Figure 4:
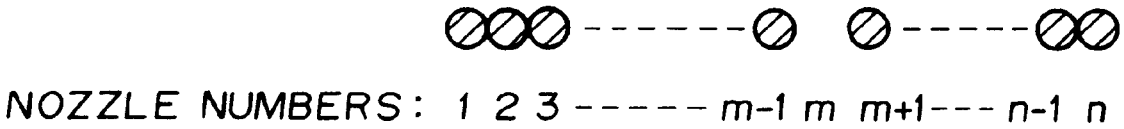
FIG. 4 is a view showing the state of printing by the BK nozzle head.

FIG. 4 shows the state of recorded dots obtained when all nozzles of the multi-nozzle head 61 for BK are made to perform an ejection operation. In this drawing, in which there are n nozzles, the mth nozzle has not ejected ink. If the presence of such a nozzle failing to eject ink (called the non-ejecting nozzle) is detected during the copying operation or the inspection of the apparatus, the resulting image is scanned with, say, a photo sensor, thereby making it possible to identify which nozzle is non-ejecting nozzle in numerical order. This information on the number of the non-ejecting nozzle can be stored beforehand in the storage device 63.

Figure 5:
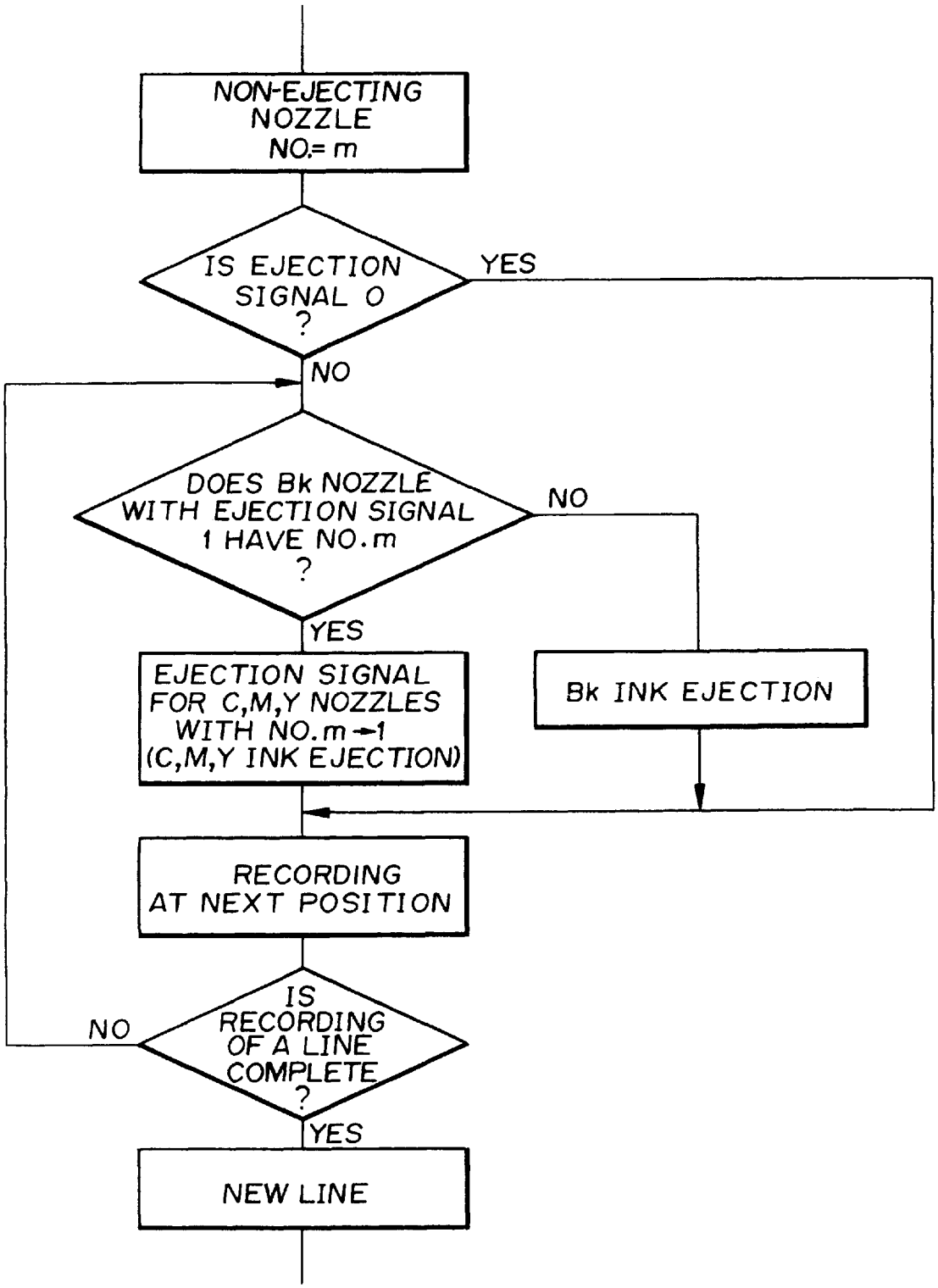
FIG. 5 is a flow chart showing an example of the flow of control.
Figure 6:
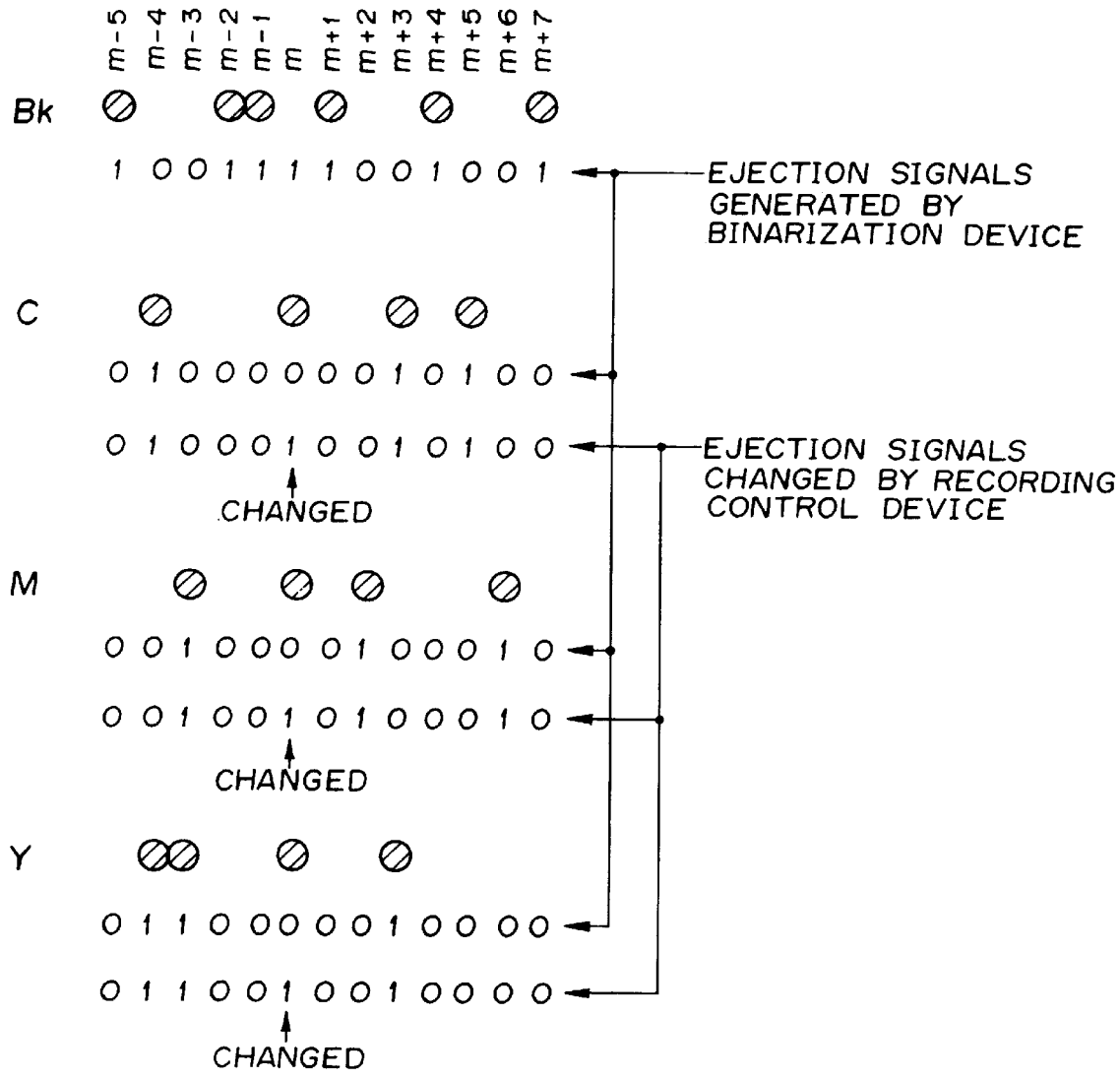
FIG. 6 is a view showing the state of ejection by other nozzles as contrasted with the state of printing by the BK nozzles as illustrated in FIG. 4.

If the non-ejecting nozzle as illustrated in FIG. 4 is present, a controlling operation as illustrated in FIGS. 5 and 6 is performed. FIG. 5 is a flow chart for the controlling operation. FIG. 6 shows the state of ejection by each nozzle. Additionally, FIG. 5 is a flow chart of only the steps for compensatory controlling of the non-ejecting BK nozzle, and is not a flow chart for the entire image forming procedure. In FIG. 6, the state of ejection by nozzles with the nozzle numbers m−5 through m+7 is illustrated.

Of the nozzles for BK, the number of the non-ejecting nozzle has already been stored in the storage device 63. Hence, whether or not the ejection signal for each BK nozzle corresponds to the stored No. of the non-ejecting nozzle is judged by the computing device 62. When, as shown in FIG. 6, the ejection signal 1 is given to the non-ejecting mth BK nozzle, i.e. when ejection is ON, the computing device informs the recording control device 57 that the signal is inappropriate. This action changes the signal for the mth nozzle of each of the other C, M and Y nozzles from 0 (state of ejection OFF) to 1 (state of ejection ON), thereby inducing ejection by these nozzles. As a result, for the Mth nozzle, a black color is formed not from BK but from a mixture of C, M and Y so that recording is performed. Therefore, even if the non-ejecting nozzle is present for BK which gives noticeably poor results in the presence of a non-ejected portion, there can be formed an image free from the non-ejected portion with the help of a substitute recording using C, M and Y.

Figure 7:
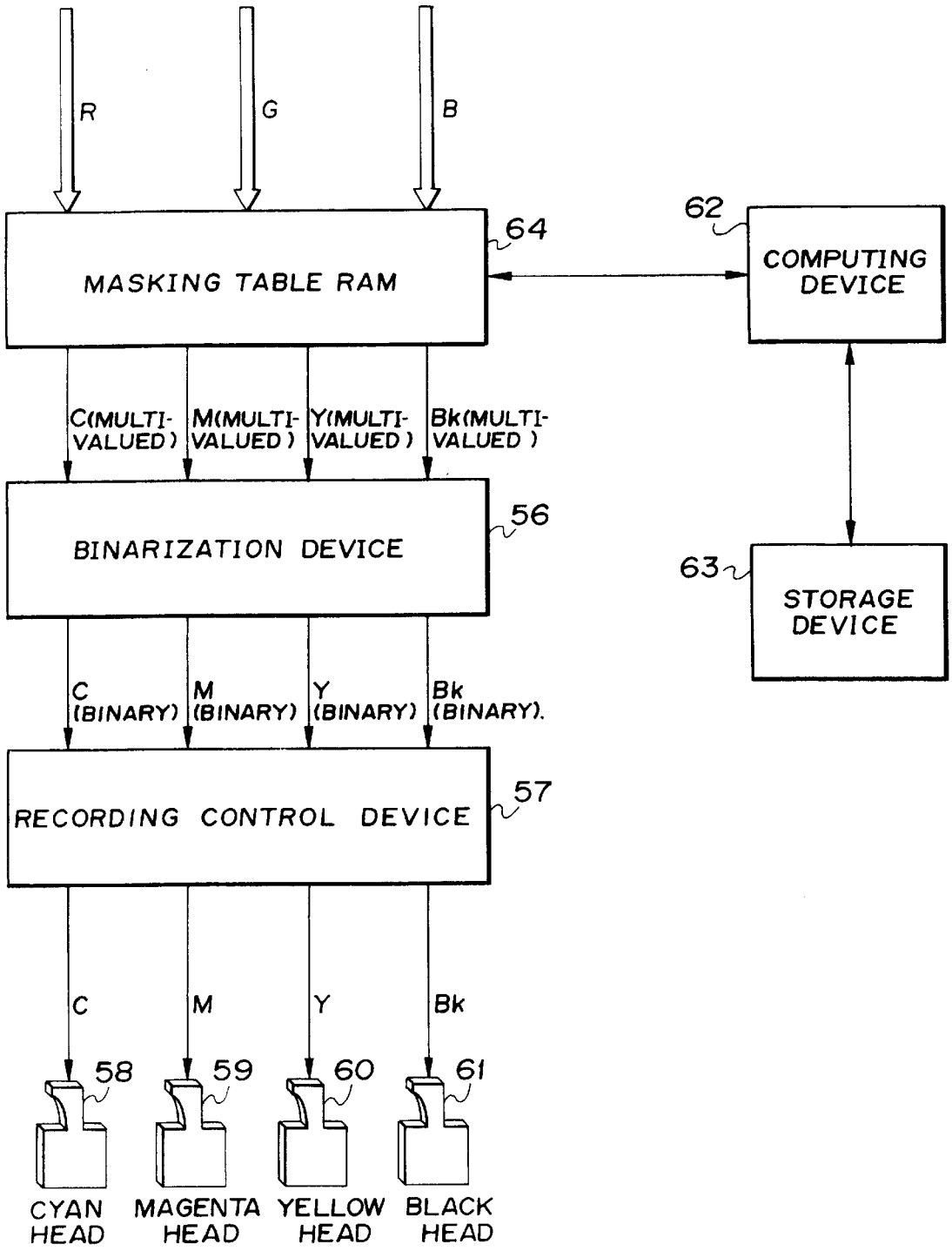
FIG. 7 is a block diagram showing the outline of other embodiment of the copying machine.

FIG. 7 is a block diagram showing another embodiment of the present invention, in which the illustrations of the original 51, light source 52 and sensor 53 revealed in FIG. 3 are omitted. The basic difference between the embodiment in FIG. 7 and that in FIG. 3 is in a masking table. That is, a masking table RAM 64 has a plurality of masking coefficients for converting R, G and B signals, which have been obtained by A/D conversion of analog signal outputs after reading of the original, into signals for C, M, Y and BK for effecting recording. A computing device 62 is capable of transforming the masking table to be used. A recording control device 57 actuates and controls recording by multi-nozzle heads. A storage device 63 has already stored information on which nozzle is a non-ejecting nozzle among the multiple nozzles for C, M, Y and BK, and receives and delivers data from and to the computing device 62, etc.

Figure 8A:
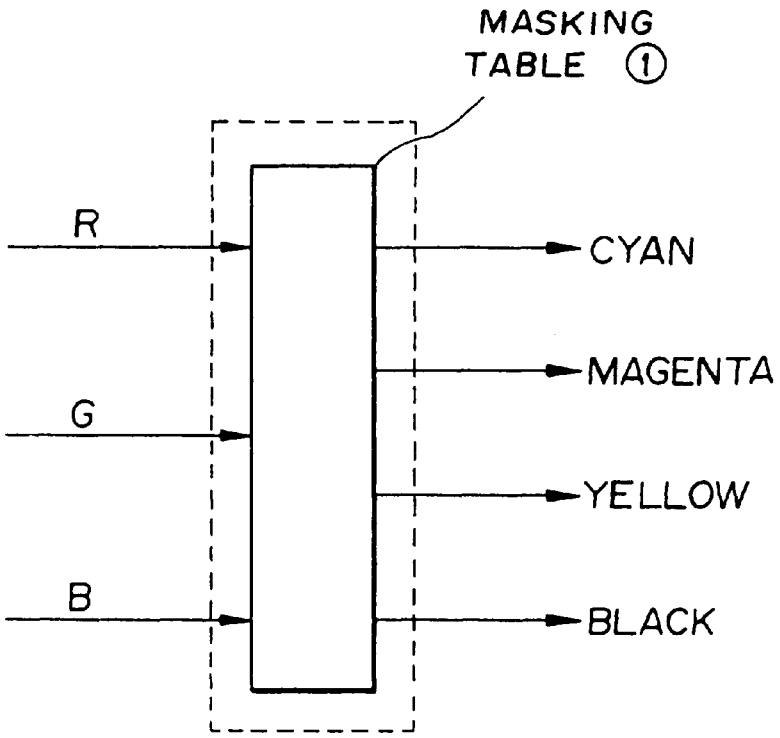
FIGS. 8A and 8B are views showing changes in the masking table illustrated in FIG. 7.
Figure 8B:
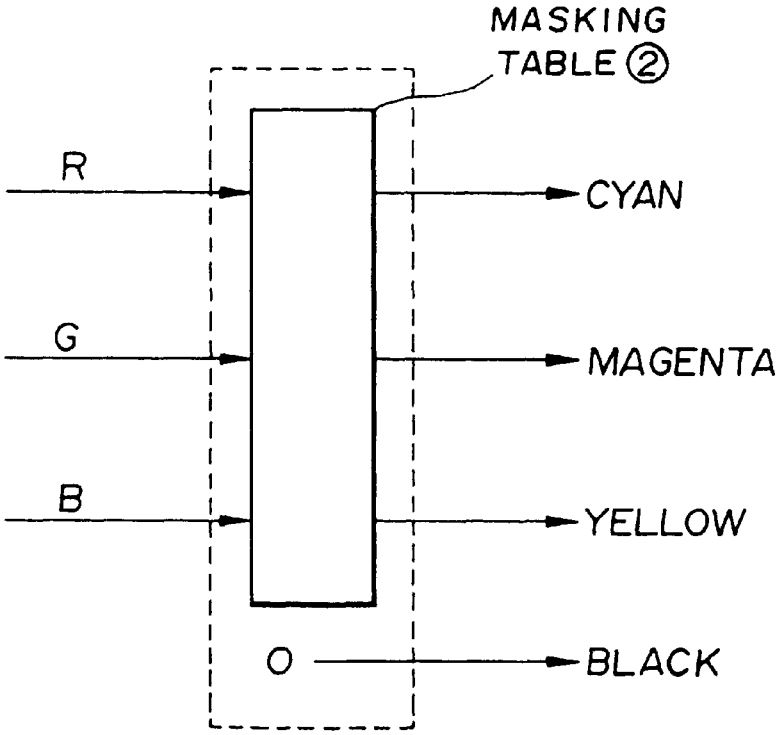

The actions of the embodiment shown in FIG. 7 will be described hereinbelow. When the BK nozzle is not non-ejecting for the portion to be printed, the signals for R, G and B entered in the masking table RAM are converted by the masking table into multi-valued signals for the components C, M, Y and BK in accordance with the proportions of the respective components R, G and B, as illustrated in FIG. 8A. However, if the corresponding BK nozzle is non-ejecting, i.e. if a certain nozzle for which the R-G-B signals should be converted into the C-M-Y-BK signals coincides with the nozzle whose non-ejecting information has been stored in the storage device 63, the computing device 62 replaces the masking table to be used. Consequently, as shown in FIG. 8B, the R, G and B signals are converted into those multi-valued signals for the C, M and Y components which correspond to the R, G and B components but do not use BK; for BK, the 0 state (the state in which no BK component is present) is applied. The resulting C, M, Y and BK signals, including those for the non-ejecting nozzle, are binarized by a binarization device 56 for producing ejection signals. These signals are entered in a recording control device 57, which drives a multi-nozzle head for each of C, M, Y and BK to effect recording. According to this construction, the conversion of the R, G and B signals into the C, M and Y signals is effected for BK whose non-ejecting portion, if any, will affect the resulting image, thus permitting recording which is not adversely affected by the non-ejection in the BK nozzle.

Furthermore, by replacing the masking table for conversion of the R, G and B signals into the C, M, Y and BK signals, the following advantage is obtained: Even if a non-ejecting portion exists in the multi-nozzle head for C, M or Y, the color corresponding to the non-ejecting portion can be compensated for by other color component or a mixture of other color components, namely, by replacing the color component at issue by a similar color component, consequently, the occurrence of a white streak in the image can be prevented. On other hand by replacing the color component by a dissimilar color component a non-ejected portion can be visually recognized in the resulting image.

In addition, the same compensative measure can be taken not only for the R, G and B components of the information read from the original for use in original copying, but also for inputs from the outside into the copying machine, namely, inputs of R, G, B information or C, M, Y, BK information.

As described in the foregoing, the present invention ensures that if an ejection signal comes to the non-ejecting nozzle of the multi-nozzle head, its function can be compensated for by ejection from nozzles for other colors, so that satisfactory recording can be performed without impairment of the resulting image.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus for ejecting ink to record on a recording medium, said ink jet recording apparatus having a recording head assembly, said recording head assembly including a plurality of recording heads corresponding to black ink, cyan ink, magenta ink and yellow ink, respectively, and each respective one of said recording heads having a plurality of ejection means for ejecting ink, comprising:

input means for inputting image signals of an image to be recorded;

conversion means for converting said inputted image signals to ejection signals which indicate to respective said ejection means of said plurality of recording heads whether to eject ink;

means for identifying that one or more particular said ejection means from among the plurality of the ejection means of the one of said recording heads corresponding to at least black ink are unable to eject ink; and conversion control means for converting at least one of the ejection signals corresponding to the particular said ejection means that are identified as unable to eject ink into at least one ejection signal for ejecting ink with ejection means provided in at least one of the recording heads corresponding to other than black ink;

wherein said conversion control means converts said ejection signals to eject ink from ejection means of the recording heads corresponding to at least cyan, magenta and yellow ink only at recording positions corresponding to recording positions of the one or more ejection means identified as unable to eject ink.

2. An ink jet recording apparatus as claimed in claim 1, wherein said ejection means comprises thermal energy generation means for generating thermal energy, and each of said recording heads generates a bubble in the ink by utilizing the thermal energy and so ejects the ink as a result of generation of the bubble.

3. An ink jet recording apparatus as claimed in claim 1, further comprising detection means for detecting the particular said ejection means which is incapable of ejecting ink.

4. An ink jet recording apparatus as claimed in claim 3, wherein said detection means performs an inspection of the apparatus, and detects the particular said ejection means which is incapable of ejecting ink during the inspection of the apparatus.

5. An ink jet recording apparatus as claimed in claim 1, further comprising reading means for reading an original to be recorded and outputting a plurality of image signals corresponding to respective colors of R, G, and B in accordance with an image information for the original.

6. An ink jet recording apparatus as claimed in claim 5, further comprising detection means for detecting the particular said ejection means which is incapable of ejecting ink.

7. An ink jet recording apparatus as claimed in claim 6, wherein said detection means performs an inspection of the apparatus, and detects the particular said ejection means which is incapable of ejecting ink during the inspection of the apparatus.

8. An ink jet recording apparatus as claimed in claim 6, wherein said detection means detects the particular said ejection means which is incapable of ejecting ink during reading of the original by said reading means.

9. An ink jet recording apparatus as claimed in claim 1, wherein said recording heads eject inks corresponding to respective colors of yellow (Y), magenta (M), cyan (C), and black (BK).

10. An ink jet recording apparatus as claimed in claim 1, wherein said conversion control means controls said color signal conversion means so that the color signal conversion means compensates for inability of the recording head for ejecting black ink to eject ink by using colors of yellow, magenta, and cyan to record images.

11. An ink jet recording apparatus as claimed in claim 1, wherein said particular ejection means incapable of ejecting ink is a nozzle itself for ejecting ink.

12. An ink jet recording apparatus as claimed in claim 1, wherein said image signals inputted by said input means are signals corresponding to red (R), green (G), blue (B), and said conversion means converts said image signals corresponding to said R, G and B to signals corresponding to a record color with said plurality of recording heads.

13. An ink jet recording apparatus as claimed in claim 12, wherein said conversion control means controls said color signal conversion means so that the color signal conversion means does not generate the second image signal for the particular said ejection means for ejecting black ink but which is incapable of ejecting the ink and instead converts the first image signal into the second image signal for the particular said ejection means corresponding to another color.

14. An ink jet recording apparatus as claimed in claim 12, wherein said conversion means converts said image signal corresponding to respective colors of R, G, and B based on a plurality of masking coefficients in a masking table.

15. An ink jet recording apparatus as claimed in claim 14, wherein said conversion control means controls said conversion means so as not to generate ejection signals only for the particular ejection means for ejecting black ink which is identified as unable to eject ink but instead converts the image signals into ejection signals for ejection means corresponding to another color by replacing said masking table with an other masking table.

16. A record signal generating apparatus for an ink jet recording apparatus, said ink jet recording apparatus having a recording head assembly, said recording head assembly including a plurality of recording heads corresponding to black ink, cyan ink, magenta ink and yellow ink, respectively, and each respective one of said recording heads having a plurality of ejection means for ejecting ink, said ink jet recording apparatus converts inputted image signals to ejection signals corresponding to the respective one of the plurality of the ejection means of the recording heads and drives the plurality of the ejection means of the recording heads to record images, comprising:

storage means for storing information regarding ejection means which are unable to eject ink from among the plurality of ejection means of the recording heads corresponding to black ink; and ejection signal converting means for converting at least one of the ejection signals corresponding to one of the ejection means of the recording head corresponding to black ink that is unable to eject ink into at least one ejection signal for ejecting ink, in accordance with information stored in said storage means, with ejection means provided in at least one of the recording heads corresponding to other than black ink, wherein said ejection signal converting means converts the ejection signals to eject ink from ejection means of the plurality of recording heads corresponding to at least cyan, magenta and yellow ink only at a recording position corresponding to a recording position of the ejection means that is unable to eject black ink.

17. A record signal generating apparatus as claimed in claim 16, wherein the information stored in said storage means is that of the position of said ejection means which is unable to eject ink among the plurality of ejection means of the recording head corresponding to black ink.

18. A method for generating ejection signals in an ink jet recording apparatus, said ink jet recording apparatus having a recording head assembly, said recording head assembly including a plurality of recording heads corresponding to black ink, cyan ink, magenta ink and yellow ink, respectively, and each respective one of said recording heads having a plurality of ejection means for ejecting ink, and said ink jet recording apparatus actuating the ejection means of the recording heads in accordance with a plurality of recording signals corresponding to record images, comprising the steps of:

inputting image signals of an image to be recorded;

converting said inputted image signals into ejection signals which indicate to respective said ejection means of said plurality of recording heads whether to eject ink; and changing at least one of the ejection signals corresponding to one of the ejection means of the recording head corresponding to black ink that is unable to eject ink into at least one ejection signal for ejecting ink with ejection means provided in at least one of the recording heads corresponding to other than black ink, wherein, in said changing step, the ejection signals are changed to eject ink from ejecting means of recording heads corresponding to at least cyan, magenta and yellow ink only at a recording position corresponding to a recording position of the ejection means that is unable to eject ink.

19. A recording method as claimed in claim 18, wherein said converting step does not generate a second image signal for the particular said ejection means which is incapable of ejecting black ink and instead converting said first image signal into a given said second image signal corresponding to another color.

20. A recording method as claimed in claim 18, further comprising the step of detecting the particular said ejection means which is incapable of ejecting ink among the recording heads.

21. A recording method as claimed in claim 20, wherein said detecting step includes inspecting the apparatus, and the detecting of the particular said ejection means which is incapable of ejecting ink is performed during the inspection of the apparatus.

22. A recording method as claimed in claim 18, wherein said converting step converts said first image signals corresponding to respective colors of R, G, and B based on a masking table.

23. A recording method as claimed in claim 22, wherein said converting step does not generate a second image signal for the particular said ejection means for ejecting black ink which is incapable of ejecting ink and instead converting said first image signal into a given said second image signal corresponding to another color by replacing said masking table.

24. A recording method as claimed in claim 18, further comprising the step of reading an original to be recorded and outputting a plurality of image signals corresponding to respective colors of R, G, and B in accordance with an image information for the original.

25. A recording method as claimed in claim 24, further comprising the step of detecting the particular said ejection means which is incapable of ejecting ink among the recording heads.

26. A recording method as claimed in claim 25, wherein said detecting step includes inspecting the apparatus, and the detecting of the particular said ejection means which is incapable of ejecting ink is performed during the inspection of the apparatus.

27. A recording method as claimed in claim 25, wherein said step of detecting the particular said ejection means which is incapable of ejecting ink is performed during reading of the original.

28. A recording method as claimed in claim 18, wherein said recording heads eject inks corresponding to respective colors of yellow (Y), magenta (M), cyan (C), and black (Bk).

29. A recording method as claimed in claim 28, wherein said converting step compensates for the recording head being incapable of ejecting black ink by instead using colors of yellow, magenta, and cyan to record images.

30. A recording method as claimed in claim 18, wherein said ejection means comprises thermal energy generation means for generating thermal energy, and each of said recording heads generates a bubble in the ink by utilizing the thermal energy and so ejects the ink as a result of generation of the bubble.

31. A recording method in an ink jet recording apparatus, said ink jet recording apparatus having a recording head assembly, said recording head assembly including a plurality of recording heads corresponding to black ink, cyan ink, magenta ink and yellow ink, respectively, and each respective one of said recording heads having a plurality of ejection means for ejecting ink, comprising the steps of:

inputting image signals of an image to be recorded;

converting said inputted image signals into ejection signals which indicate to respective said ejection means of said recording heads whether to eject ink; and changing at least one of the ejection signals corresponding to one of the ejection means of the recording head corresponding to black ink that is unable to eject ink into at least one ejection signal for ejecting ink with ejection means provided in at least one of the recording heads corresponding to other than black ink, wherein, in said changing step, said ejection signals are converted to eject ink from ejecting means of recording heads corresponding to at least cyan, magenta and yellow ink only at a recording position corresponding to a recording position of the ejection means that is unable to eject ink.

32. A recording method as claimed in claim 31, further comprising the step of detecting the particular said ejection means which is incapable of ejecting ink among the recording heads.

33. A recording method as claimed in claim 32, wherein said step of detecting includes inspecting the apparatus, and the detecting of the particular said ejection means which is incapable of ejecting ink is performed during the inspection of the apparatus.

34. A recording method as claimed in claim 31, further comprising the step of reading an original to be recorded and outputting a plurality of image signals corresponding to respective colors of R, G, and B in accordance with an image information for the original.

35. A recording method as claimed in claim 34, further comprising the step of detecting the particular said ejection means which is incapable of ejecting ink among the recording heads.

36. A recording method as claimed in claim 35, wherein said step of detecting includes inspecting the apparatus, and the detecting of the particular said ejection means which is incapable of ejecting ink is performed during the inspection of the apparatus.

37. A recording method as claimed in claim 35, wherein said step of detecting the particular said ejection means which is incapable of ejecting ink is performed during reading of the original.

38. A recording method as claimed in claim 31, wherein said recording heads eject inks corresponding to respective colors of yellow (Y), magenta (M), cyan (C), and black (Bk).

39. A recording method as claimed in claim 38, wherein said converting step compensates for the recording head being incapable of ejecting black ink by instead using colors of yellow, magenta, and cyan to record images.

40. A recording method as claimed in claim 31, wherein said ejection means comprises thermal energy generation means for generating thermal energy, and each of said recording heads generates a bubble in the ink by utilizing the thermal energy and so ejects the ink as a result of generation of the bubble.

41. A method as claimed in claim 31, wherein said image signals inputted by said input step are signals corresponding to red (R), green (G), blue (B), and said changing step converts said image signals corresponding to said R, G and B to signals corresponding to a record color with said plurality of recording heads.

42. A recording method as claimed in claim 41, wherein said converting step does not generate a second image signal for the particular said ejection means which is incapable of ejecting black ink and instead converting said first image signal into a given said second image signal corresponding to another color.

43. A recording method as claimed in claim 41, wherein said converting step converts said first image signals corresponding to respective colors of R, G, and B based on a masking table.

44. A recording method as claimed in claim 43, wherein said converting step does not generate a second image signal for the particular said ejection means for ejecting black ink which is incapable of ejecting ink and instead converting said first image signal into a given said second image signal corresponding to another color by replacing said masking table.

* * * * *

UNITED STATES PATENT AND TRADEMARK OFFICE

CERTIFICATE OF CORRECTION

PATENT NO. : 6,033,054

DATED : March 7, 2000

INVENTOR : Eiichi Takagi

It is certified that error appears in the above-identified patent and that said Letters Patent is hereby corrected as shown below:

References Cited

FOREIGN PATENT DOCUMENTS

"03267864" should read --03-267864--;
"03267865" should read --03-267865--; and
"03267866" should read --03-267866--.

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*